US007481690B2

(12) United States Patent
Shibata

(10) Patent No.: US 7,481,690 B2
(45) Date of Patent: Jan. 27, 2009

(54) SURFBOARD FIN

(75) Inventor: Toshimichi Shibata, 8366-16, Ichinomiya, Ichinomiyamchi, Chosei-gun, Chiba (JP) 299-4301

(73) Assignee: Toshimichi Shibata, Chiba (JP)

( * ) Notice: Subject to any disclaimer, the term of this patent is extended or adjusted under 35 U.S.C. 154(b) by 0 days.

(21) Appl. No.: 11/842,658

(22) Filed: Aug. 21, 2007

(65) Prior Publication Data

US 2008/0050994 A1 Feb. 28, 2008

(30) Foreign Application Priority Data

Aug. 23, 2006 (JP) ..... 2006-226132

(51) Int. Cl.
*B63B 1/00* (2006.01)

(52) U.S. Cl. ..... 441/79

(58) Field of Classification Search ..... 441/79
See application file for complete search history.

(56) References Cited

U.S. PATENT DOCUMENTS

| | | | | |
|---|---|---|---|---|
| 3,564,632 | A | 2/1971 | Bahne, Jr. | |
| 5,176,096 | A * | 1/1993 | Molnar et al. | 114/127 |
| 5,493,989 | A * | 2/1996 | Anderson | 114/138 |
| 5,649,846 | A * | 7/1997 | Harper et al. | 441/79 |
| 6,386,933 | B1 * | 5/2002 | Rewald et al. | 441/74 |
| 7,182,661 | B2 * | 2/2007 | Sams et al. | 441/79 |

* cited by examiner

*Primary Examiner*—Jesús D Sotelo
(74) *Attorney, Agent, or Firm*—Young & Thompson

(57) ABSTRACT

An adjustable surfboard fin inserted and secured into a groove-like securing member buried in a bottom of a surfboard, wherein an inserted portion is made of an elastic member and divided into two pieces in a thickness direction of the adjustable surfboard fin, thereby enabling a slit formed between the two pieces to be adjustable by a setscrew is provided.

2 Claims, 6 Drawing Sheets

SURFBOARD FIN

BACKGROUND OF THE INVENTION

1. Field of the Invention

The present invention relates to an adjustable surfboard fin fitted into a bottom of a surfboard used in surfing.

2. Description of the Related Art

Surfing is one of marine leisure activities that recently has become a major sport in Japan. Types of surfing include not only ordinary surfing using a surfboard on which a surfer rides, windsurfing using a surfboard with a sail, and bodyboarding using a surfboard called "bodyboard" held in the arms of a bodyboarder. These activities of surfing are similar in that a surfboard is used.

As shown in FIG. 7, a surfboard fin 3 is fitted into a rear-end position on a bottom of a surfboard 1 sunk under water for improving surfboard handling. Although some fixed surfboard fins are known, more surfboard fins are detachably attached to the positions each via a securing member 2 for various reasons such as replacement after damage, wear or the like and change of magnitude according to purposes. The surfboard fin of the latter type will be referred to as "adjustable surfboard fin", hereinafter.

U.S. Pat. No. 3,564,632, granted in the US that is a leading country in the surfing, relates to a securing structure for securing such an adjustable surfboard fin. It is disclosed in the U.S. Pat. No. 3,564,632 that a groove of a securing member and a bottom of the surfboard fin are both inclined, and that screws are provided in front of and in rear of a bottom member of the surfboard fin and fastened to the securing member, thereby securing the surfboard fin into a suitable position.

Similarly to the invention disclosed in the U.S. Pat. No. 3,564,632, a surfboard fin configured so that only one screw is arranged at one position and a fulcrum pin is arranged at the other position is commercially available. The surfboard fin will be described with reference to FIGS. 8 to 11.

FIG. 8 is a partial longitudinal sectional view of a surfboard showing a fitting portion into which an adjustable surfboard fin is fitted. FIG. 9 is a cross-sectional view of the surfboard in a right-angle direction. FIG. 10 is a perspective view showing principal parts of the adjustable surfboard fin. In FIGS. 8 to 10, reference symbol 1 denotes a surfboard, 2 denotes a securing member into which the surfboard fin is secured, 3 denotes the surfboard fin, 31 denotes a fulcrum pin provided near a rear end of an inserted portion 34 of the surfboard fin 3 inserted into the securing member 2, 32 denotes a fixed screw provided on a front end of the inserted portion 34, and 33 denotes a nut.

FIG. 11 is a partial perspective view of the surfboard 1 showing the securing member 2 and its surroundings. In FIG. 11, reference symbol 21 denotes a longitudinal groove, 22 denotes a transverse groove formed in a sidewall of the longitudinal groove 21, and 23 denotes a notch formed near the center of the longitudinal groove 21.

If the surfboard fin 3 is to be fitted into the surfboard 1, then the fulcrum pin 31 of the surfboard fin 3 is inserted into the securing member 2 from the notch 23, the surfboard fin 3 is moved, and the nut 33 is inserted from the notch 23 similarly to the fulcrum pin 31. Next, the surfboard fin 3 is moved back and forth to be positioned to a desired position, and the fixing screw 32 is fastened to thereby secure the surfboard fin 3 into the desired position. The fulcrum pin 31 and the nut 33 together with the surfboard fin 3 are moved in the transverse groove 22.

As a material of the surfboard 1 and the surfboard fin 3, a light and tough material such as FRP or ABS resin is used in view of portability and a buoyant force when in use, that is, in view of a combination of a weight, a specific gravity, and a strength.

However, as can be understood from FIG. 9, if the surfboard fin 3 is repeatedly attached and detached, then the securing member 2 and/or the inserted portion 34 of the surfboard fin 3 may possibly be worn and deformed, a gap is generated or the surfboard fin 3 becomes unstable. This disadvantageously causes deterioration in steering performance and degradation in safety.

SUMMARY OF THE INVENTION

It is an object of the present invention to provide a surfboard fin capable of being firmly secured into a surfboard without causing the above-stated fitting instability.

According to an aspect of the present invention, there is provided an adjustable surfboard fin inserted and secured into a groove-like securing member buried in a bottom of a surfboard, comprising an inserted portion, wherein a thickness of the inserted portion is changeable. It is preferable that the inserted portion is made of an elastic member and divided into two pieces in a thickness direction of the adjustable surfboard fin, thereby enabling a slit formed between the two pieces to be changeable by a setscrew attached to the inserted portion. Alternatively, it is preferable that a plurality of adjustment screws is attached to the inserted portion in a thickness direction of the adjustable surfboard fin, and that a height of each of the plurality of adjustment screws is changeable in the thickness direction by rotation of each of the plurality of adjustment screws.

According to the present invention, a fitted state of the inserted portion of the surfboard fin 3 can be adjusted. Due to this, even if the surfboard fin 3 is repeatedly attached and detached, it is possible to keep the surfboard fin 3 in a firmly secured state without shaking or a gap. Therefore, the present invention exhibits excellent advantages of improved steering performance and improved safety.

DESCRIPTION OF THE PREFERRED EMBODIMENTS

The present invention relates to an adjustable surfboard fin secured into a surfboard by inserting an inserted portion of the surfboard fin into a groove-like securing member buried in a bottom of the surfboard. The adjustable surfboard fin is adjustable not only in a longitudinal direction but also in a thickness of the inserted portion. Due to this, even if a groove of the securing member is deformed or worn, it is always possible to ensure that the inserted portion is firmly fitted into the groove. Therefore, the adjustable surfboard fin according to the present invention is free from unstableness.

First Embodiment

Figure 1:
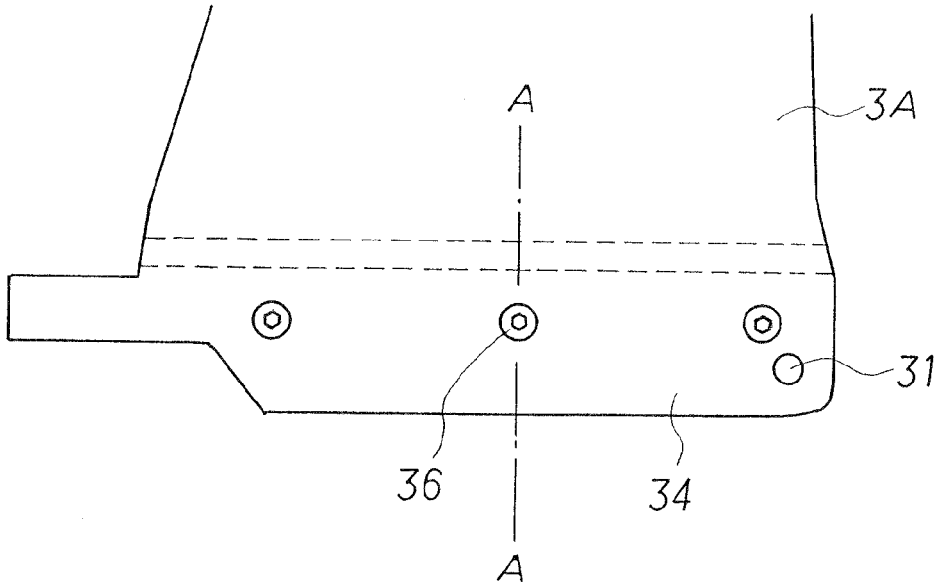
FIG. 1 is a front view showing principal parts of a surfboard fin according to a first embodiment of the present invention.
Figure 2:
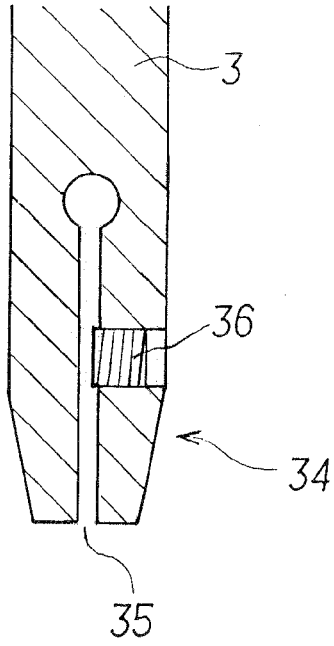
FIG. 2 is a cross-sectional view taken along a line A-A of FIG. 1.

A surfboard fin 3A according to a first embodiment of the present invention will be described with reference to FIGS. 1 to 3. FIG. 1 is a front view showing principal parts of the surfboard fin 3A according to the first embodiment. FIG. 2 is a cross-sectional view taken along a line A-A of FIG. 1. In FIGS. 1 and 2, the same constituent elements as those shown in FIGS. 8 to 11 according to the conventional technique are denoted by the same reference symbols. Additionally, reference symbol 35 denotes a slit of the inserted portion 34 at which the inserted portion 34 is divided into two pieces in a thickness direction of the surfboard fin 3. Reference symbol 36 denotes a setscrew, and a plurality of setscrews 36 is attached to the insertion portion 34 in a longitudinal direction of the surfboard fin 3A.

The surfboard fin 3A according to the first embodiment is configured so that at least the inserted portion 34 is made of an elastic material such as ABS resin, and so that the surfboard fin 3A is divided into two pieces in the thickness direction of the surfboard fin 3A. A plurality of setscrews 36 is provided on one of the two pieces to be directed toward the other piece. By forcing the setscrews 36 into the inserted portion 34, it is possible to set the thickness of the inserted portion 34 to be slightly larger than a width of the longitudinal groove 21, into which the inserted portion 34 is inserted, in a pre-insertion state, to restrict a deformation amount during fitting, and to firmly fit the surfboard fin 3A into the securing member 2 with an appropriate interference.

If wearing or deformation of the longitudinal groove 21 of the securing member 2 becomes recognizable, then one of the setscrews 36 located at a position corresponding to or near a worn or deformed portion is adjusted, and the thickness of the inserted portion 34 is changed so that the interference during fitting is equal to an appropriate value.

Figure 3:
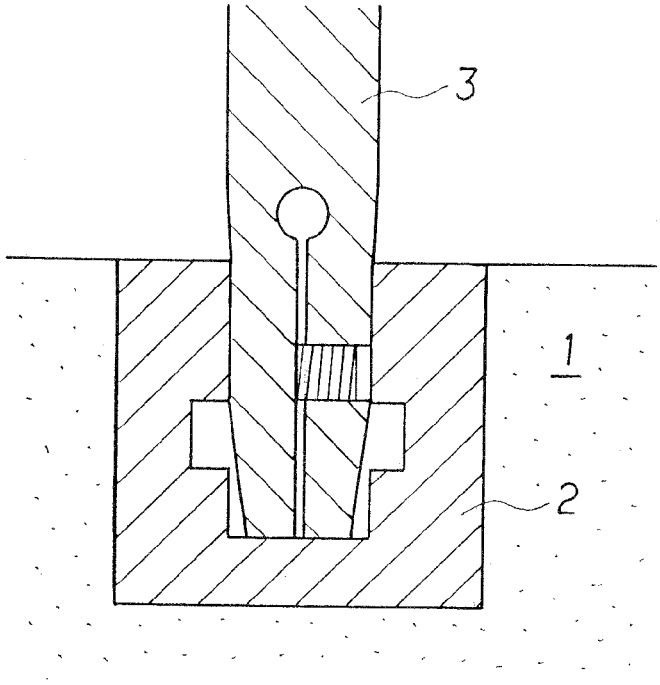
FIG. 3 is a cross-sectional view showing a state in which the surfboard fin according to the first embodiment is fitted into a securing member.

FIG. 3 is a cross-sectional view showing a state in which the surfboard fin 3A is fitted into the securing member 2.

An elastic member such as an urethane sheet may be inserted into the slit 35 without providing the setscrews 36 so as to reinforce an elastic force of the inserted portion 34 and to firmly fit the surfboard fin 3A into the securing member 2 with the reinforced elastic force. In another alternative, the thickness of the inserted portion 34 may be by changed by an elastic deformation of a material of the inserted portion 34 itself without using the urethane sheet or the like, and the surfboard fin 3A may be fitted into the securing member 2.

Second Embodiment

Figure 4:
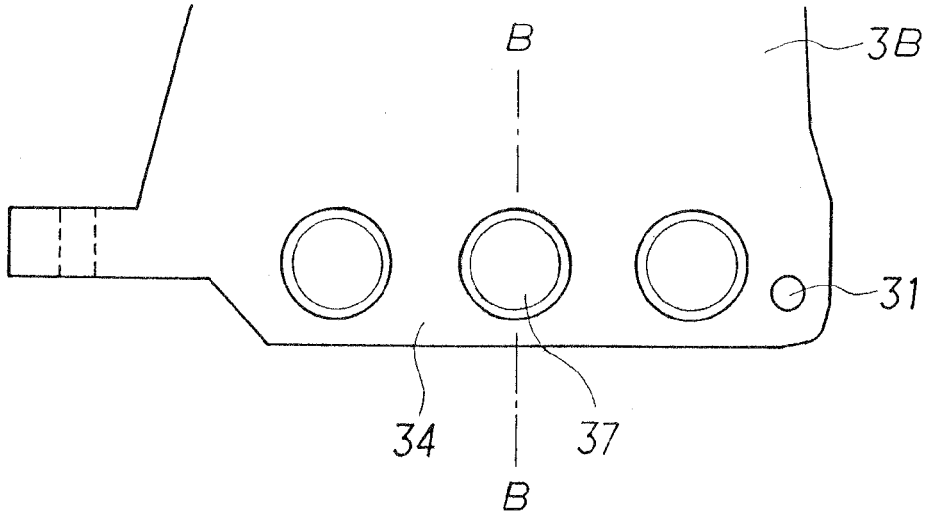
FIG. 4 is a front view showing principal parts of a surfboard fin according to a second embodiment of the present invention.
Figure 5:
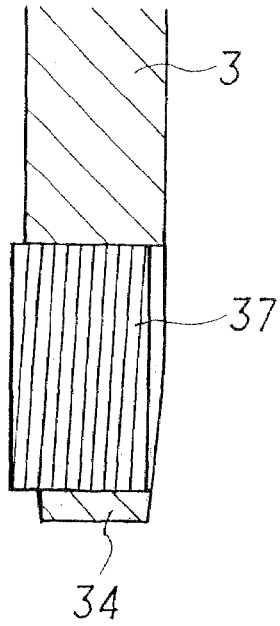
FIG. 5 is a cross-sectional view taken along a line B-B of FIG. 4.

A surfboard fin 3B according to a second embodiment of the present invention will be described with reference to FIG. 4 to 6. FIG. 4 is a front view showing principal parts of the surfboard fin 3B according to the second embodiment. FIG. 5 is a cross-sectional view of the surfboard fin 3B taken along a line B-B of FIG. 4. In FIGS. 4 and 5, the same constituent elements as those shown in FIGS. 8 to 11 according to the conventional technique are denoted by the same reference symbols. Additionally, reference symbol 37 denotes a large-diameter adjustment screw. A plurality of large-diameter adjustment screws 37 is attached to the insertion portion 34 in the cross direction of the surfboard fin 3B.

The surfboard fin 3B according to the second embodiment is configured so that at least the inserted portion 34 is made of a material having a sufficient strength to enable the internal threads 37 to be worked or so that the internal threads 37 each having a sufficient strength are buried in the inserted portion 34. If the adjustment screws 37 are forced into the inserted portion 34 and protruded from a surface of the surfboard fin 3B, it is possible to increase an apparent thickness of the inserted portion 34. Accordingly, if wearing or deformation of the longitudinal groove 21 of the securing member 2 becomes recognizable, then one of the adjustment screws 37 located at a position corresponding to or near a worn or deformed portion is forced out, and the apparent thickness of the inserted portion 34 is changed. On the side on which the adjustment screws 37 protrude, the inserted portion 34 of the surfboard fin 3 does not contact with the sidewall of the longitudinal groove 21 of the securing member 2 but only a tip end of each adjustment screw 37 contacts with the sidewall thereof. It is, therefore, preferable to set a diameter of each adjustment screw 37 as large as possible to increase a contact area between the adjustment screw 37 and the sidewall.

Figure 6:
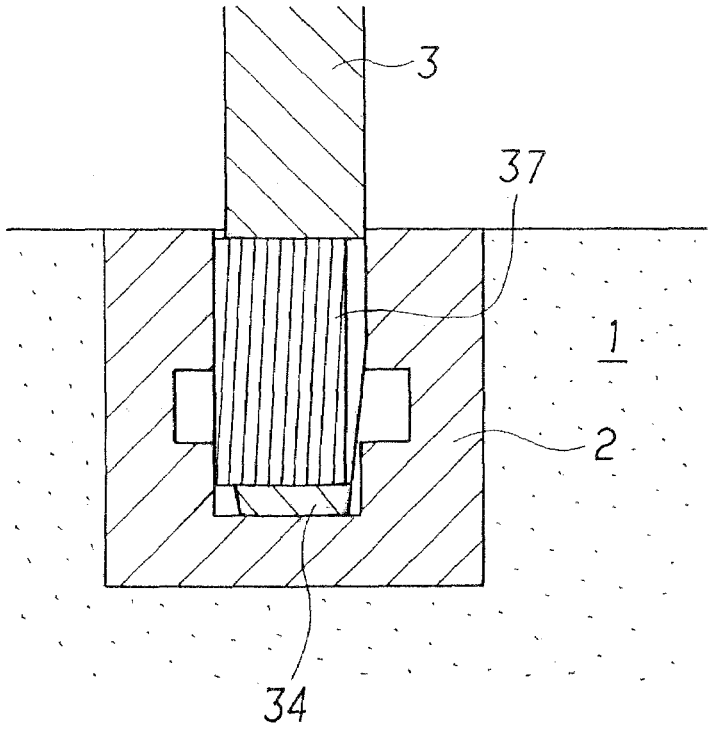
FIG. 6 is a cross-sectional view showing a state in which the surfboard fin according to the second embodiment is fitted into a securing member.
Figure 7:
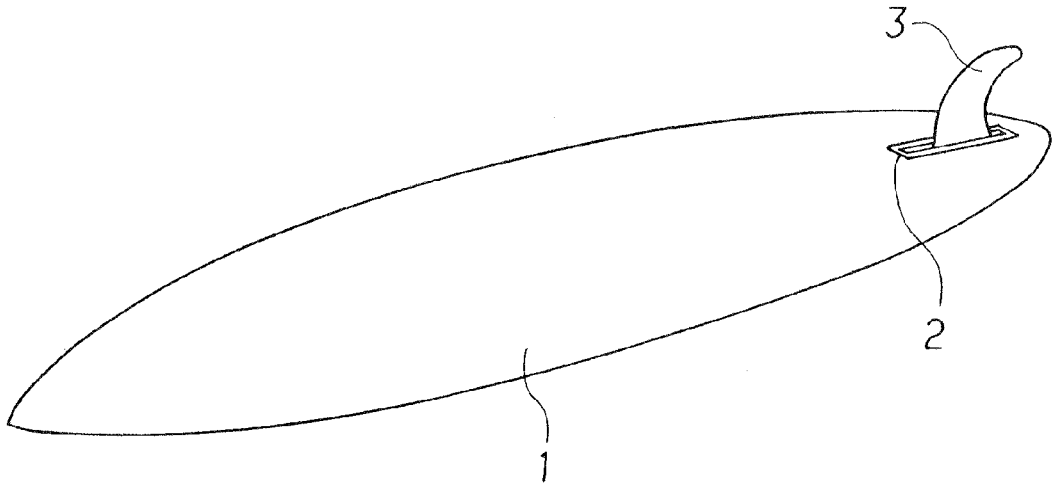
FIG. 7 is a perspective view of a surfboard according to the present invention.
Figure 8:
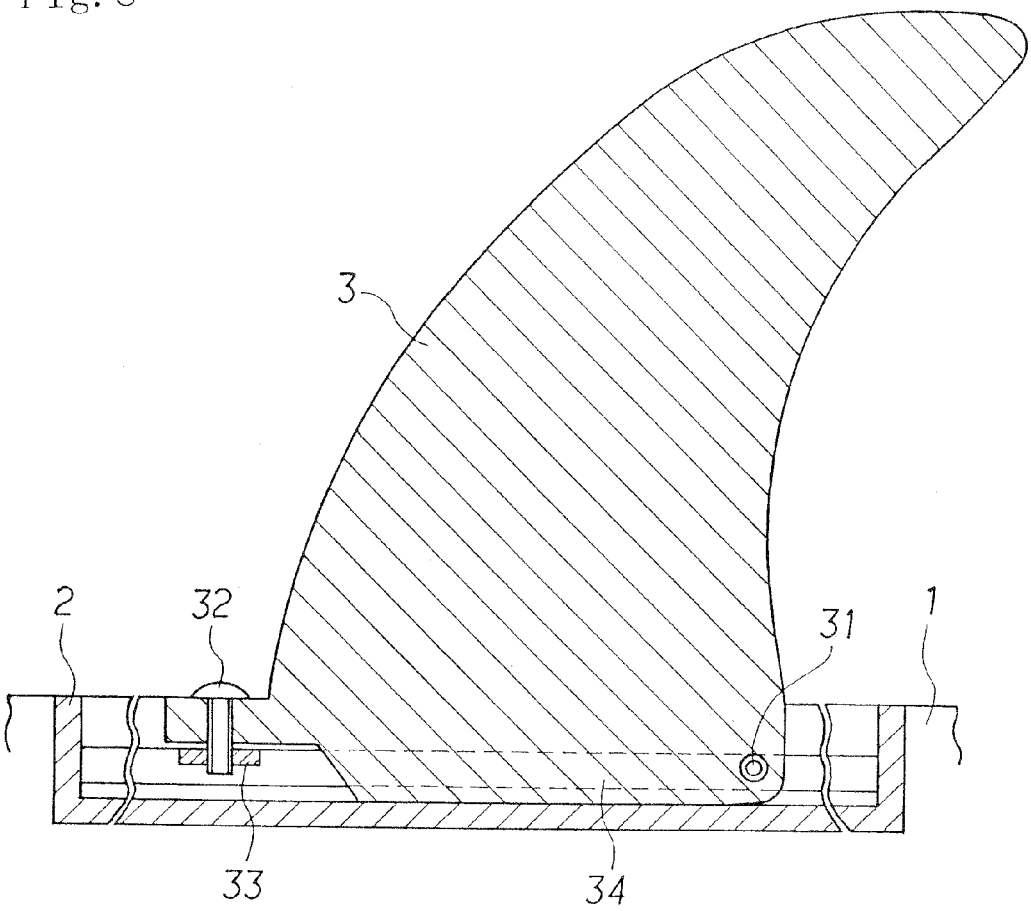
FIG. 8 is a partial longitudinal sectional view of a surfboard showing a surfboard fin attachment structure according to a conventional technique.
Figure 9:
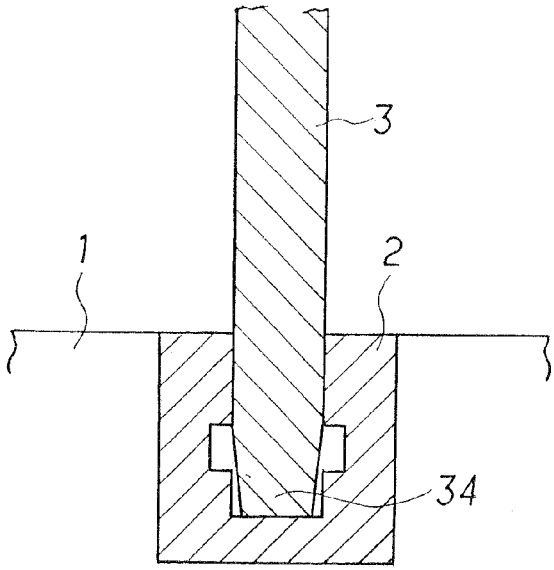
FIG. 9 is a partial sectional view of the surfboard shown in FIG. 8 in a right angle direction according to the conventional technique.
Figure 10:
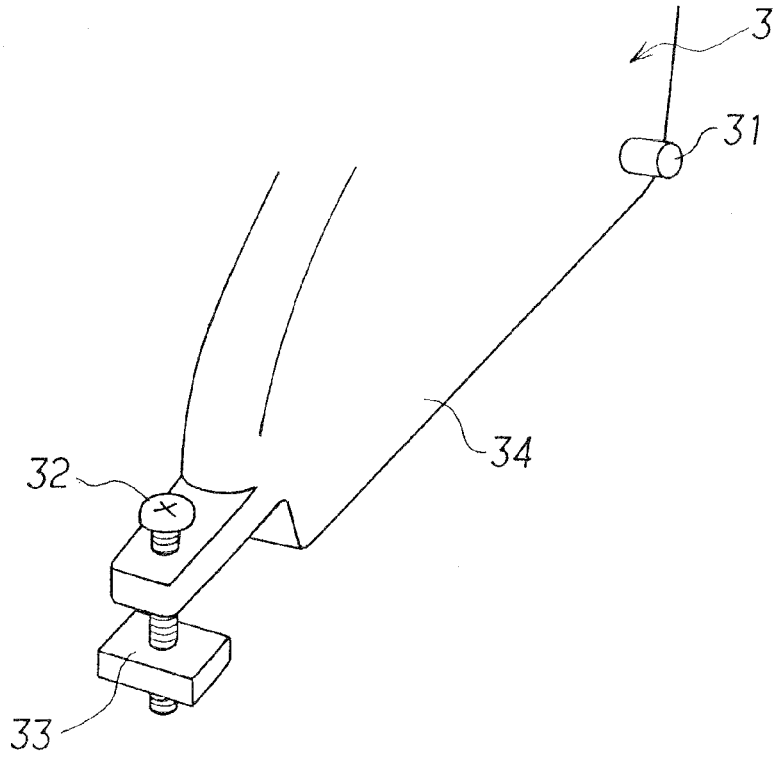
FIG. 10 is a perspective view showing principal parts of the surfboard fin according to the conventional technique.
Figure 11:
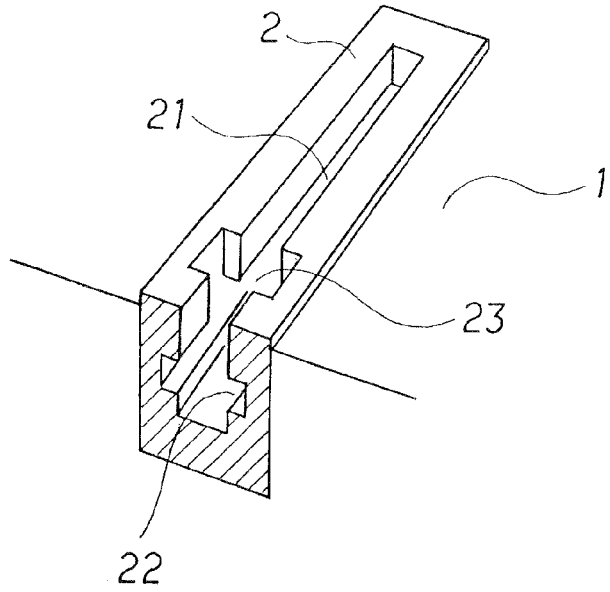
FIG. 11 is a partial perspective view of the surfboard showing a securing member and its surroundings according to the present invention.

FIG. 6 a cross-sectional view showing a state in which the surfboard fin 3B is fitted into the securing member 2.

What is claimed is:

1. An adjustable surfboard fin inserted and secured into a groove-like securing member buried in a bottom of a surfboard, comprising:

an inserted portion, a thickness of the inserted portion is changeable; and a plurality of adjustment screws, the plurality of adjustment screws attached to the inserted portion in a thickness direction of the adjustable surfboard fin, and each of the plurality of adjustment screws protrudes beyond the surface of the inserted portion to change the thickness of the inserted portion by rotation of each of the plurality of adjustment screws.

2. The adjustable surfboard fin according to claim 1, wherein each of the adjustable screws has a tip of a protruding portion that comes in contact with a sidewall of the groove-like securing member.

* * * * *